US010516229B2

(12) United States Patent
Nakamura et al.

(10) Patent No.: US 10,516,229 B2
(45) Date of Patent: Dec. 24, 2019

(54) CONNECTOR

(71) Applicant: Yazaki Corporation, Tokyo (JP)

(72) Inventors: Masatoshi Nakamura, Shizuoka (JP); Kazuto Ohtaka, Shizuoka (JP); Yuta Masuda, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/373,549

(22) Filed: Apr. 2, 2019

(65) Prior Publication Data

US 2019/0312373 A1 Oct. 10, 2019

(30) Foreign Application Priority Data

Apr. 4, 2018 (JP) ..... 2018-072283

(51) Int. Cl.
*H01R 4/48* (2006.01)
*H01R 13/422* (2006.01)
*H01R 13/436* (2006.01)

(52) U.S. Cl.
CPC ..... *H01R 13/4223* (2013.01); *H01R 13/4364* (2013.01)

(58) Field of Classification Search
CPC ..... H01R 13/4223; H01R 13/4364; H01R 13/422; H01R 4/2433; H01R 13/4365
See application file for complete search history.

(56) References Cited

U.S. PATENT DOCUMENTS 7,794,267 B2 * 9/2010 Daily ..... H01R 4/2433 439/402
9,941,619 B2 * 4/2018 Wada ..... H01R 13/422
2003/0027456 A1 2/2003 Yamawaki et al.
2005/0124216 A1 * 6/2005 Sagawa ..... H01R 13/4365 439/595
2006/0240718 A1 10/2006 Osada et al.
2007/0020997 A1 1/2007 Miyakawa
2009/0311896 A1 * 12/2009 Myer ..... H01R 13/4365 439/248

FOREIGN PATENT DOCUMENTS

JP 2003-45546 A 2/2003

* cited by examiner

*Primary Examiner* — Jean F Duverne
(74) *Attorney, Agent, or Firm* — Kenealy Vaidya LLP

(57) ABSTRACT

A locking structure LS includes: a locking protrusion provided on a front holder and formed to protrude in a vertical direction; locking arms provided on a female housing and formed to extend in a fitting direction; and regulating surfaces provided to face the locking protrusion in a width direction and regulate movement of the locking arms in the width direction. The locking arms are inserted between the locking protrusion and the regulating surfaces, have locking portions formed to partially overlap with the locking protrusions, and can be elastically deformed in the vertical direction with respect to the female housing.

4 Claims, 13 Drawing Sheets

CONNECTOR

CROSS-REFERENCE TO RELATED APPLICATION(S)

The present application claims priority to and incorporates by reference the entire contents of Japanese Patent Application No. 2018-072283 filed in Japan on Apr. 4, 2018.

BACKGROUND OF THE INVENTION

1. Field of the Invention

The present invention relates to a connector.

2. Description of the Related Art

Conventional connectors applied to wire harnesses or the like include a connector having a front holder that regulates movement of a terminal accommodated in a connector housing. The front holder is locked with respect to the connector housing by a locking structure, thereby being fixed to the connector housing (see, Japanese Patent Application Laid-open No. 2003-45546).

As the locking structure to lock the front holder to the connector housing, there is a locking structure which includes a pair of locking arms provided on a connector housing and a locking protrusion to be inserted between the pair of locking arms. Each of the pair of locking arms has a full locking protrusion and a temporary locking protrusion formed on a side facing the locking protrusion in a width direction. When the locking protrusion is inserted between the pair of locking arms so that the locking protrusion comes into contact with the full locking protrusion or the temporary locking protrusion, the locking arms are deformed as the locking arms are pressed toward the side opposite to the locking protrusion side by the locking protrusion. As a result, the locking structure is turned into a temporarily locked state as the locking protrusion overrides the temporary locking protrusion in the width direction, and further, is turned into a fully locked state as the locking protrusion overrides the full locking protrusion in the width direction.

Meanwhile, a regulating surface is formed on the front holder on a side opposite to the locking protrusion with the locking arms interposed therebetween in the locking structure in order to prevent the locked state from being released in the temporarily locked state and the fully locked state. Therefore, when the locking protrusion is inserted between the pair of locking arms, the locking arms are forcibly inserted between the locking protrusion and the regulating surface when viewed from an insertion direction. That is, since the locking arms are forcibly inserted between the locking protrusion and the regulating surface, there is a concern that the temporary locking protrusion and the full locking protrusion of the locking arm may rear and each holding force in the temporarily locked state and the fully locked state may decrease.

SUMMARY OF THE INVENTION

The present invention has been made in view of the above description, and an object thereof is to provide a connector capable of suppressing a decrease of a holding force generated by a locking structure.

A connector according to one aspect of the present invention includes a connector housing that accommodates a terminal to be connected in a fitting direction to a mating terminal accommodated in a mating connector housing; a front holder into which a part of the connector housing is inserted and that regulates movement of the terminal in a detachment direction of the fitting direction; and a locking structure that locks the front holder with respect to the connector housing, wherein the locking structure includes a locking protrusion provided on one of the connector housing and the front holder and formed to protrude in a first direction orthogonal to the fitting direction, at least one locking arm provided on the other of the connector housing and the front holder and formed to extend in the fitting direction, and at least one regulating surface provided to face the locking protrusion in a second direction orthogonal to the fitting direction and the first direction and regulating movement of the locking arm in the second direction when the locking arm faces the locking protrusion in the second direction, the locking arm is inserted between the locking protrusion and the regulating surface and in which one or more locking portions at least partly overlapping with the locking protrusion are formed when viewed from the fitting direction, one of the locking arm and the locking protrusion is a deformable member that is elastically deformable in the first direction and the second direction with respect to the connector housing or the front holder provided with the one of the locking arm and the locking protrusion, and the deformable member elastically deforms in the first direction when the locking portion and the locking protrusion face each other in the second direction so that the locking portion overrides the locking protrusion.

According to another aspect of the present invention, in the connector, a pair of the locking arms may be provided to be apart from each other in the second direction, the locking protrusion may be inserted between the pair of locking arms, and a pair of the regulating surfaces may be provided to be apart from each other in the second direction.

According to still another aspect of the present invention, in the connector, the locking protrusion may be formed to protrude in the second direction in a recessed portion formed by causing a part of the front holder to be recessed inward, the regulating surface may be a side surface forming the recessed portion, and the locking arm may be inserted into the recessed portion when being inserted between the locking protrusion and the regulating surface.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment according to the present invention will be described in detail with reference to the drawings. Incidentally, the invention is not limited by the embodiment. In addition, constituent elements in the following embodiment include one that can be replaced by a person skilled in the art or substantially the same one.

Embodiment

Figure 1:
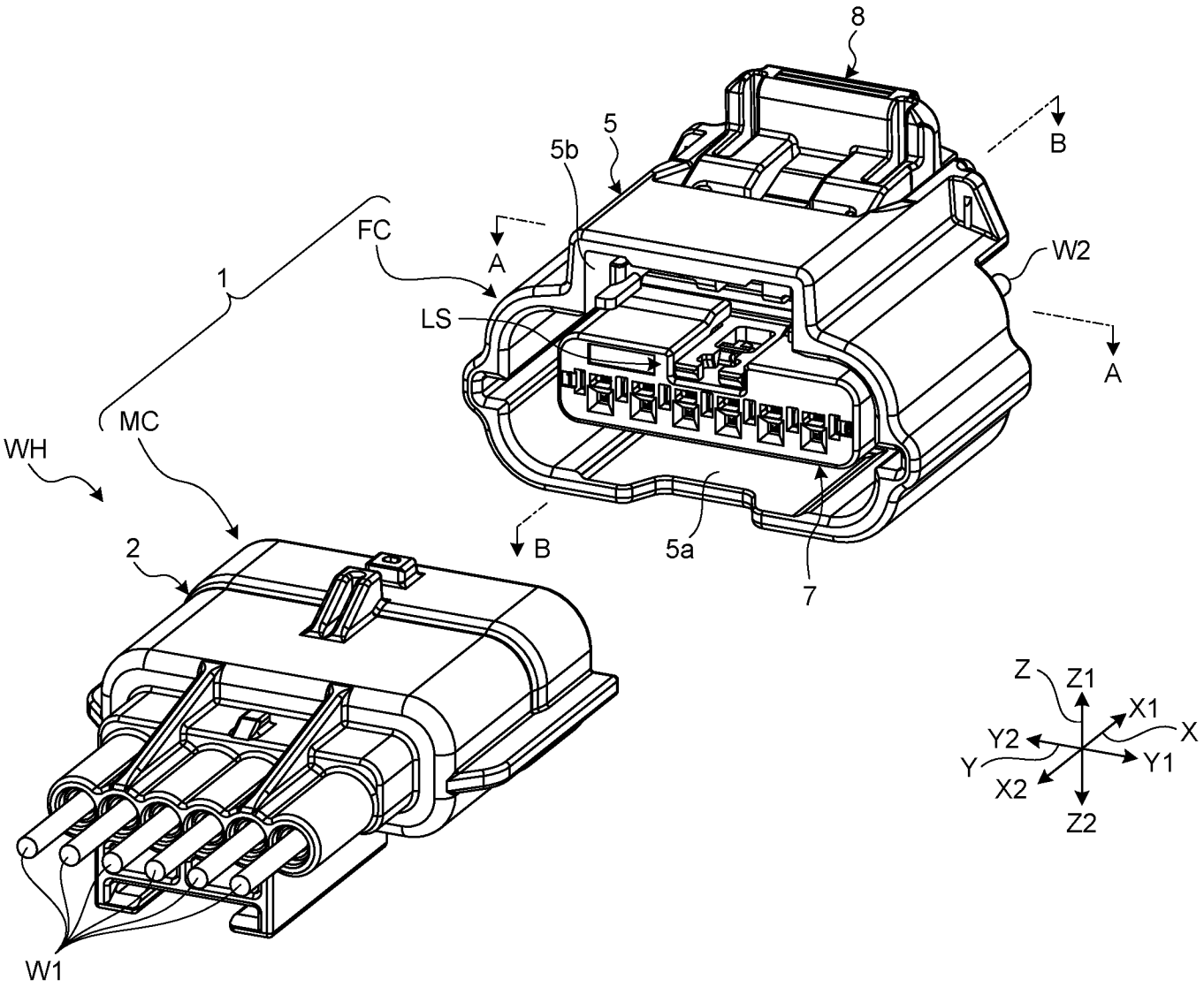
FIG. 1 is a perspective view illustrating a CPA connector including a connector (female connector) according to the present embodiment.
Figure 2:
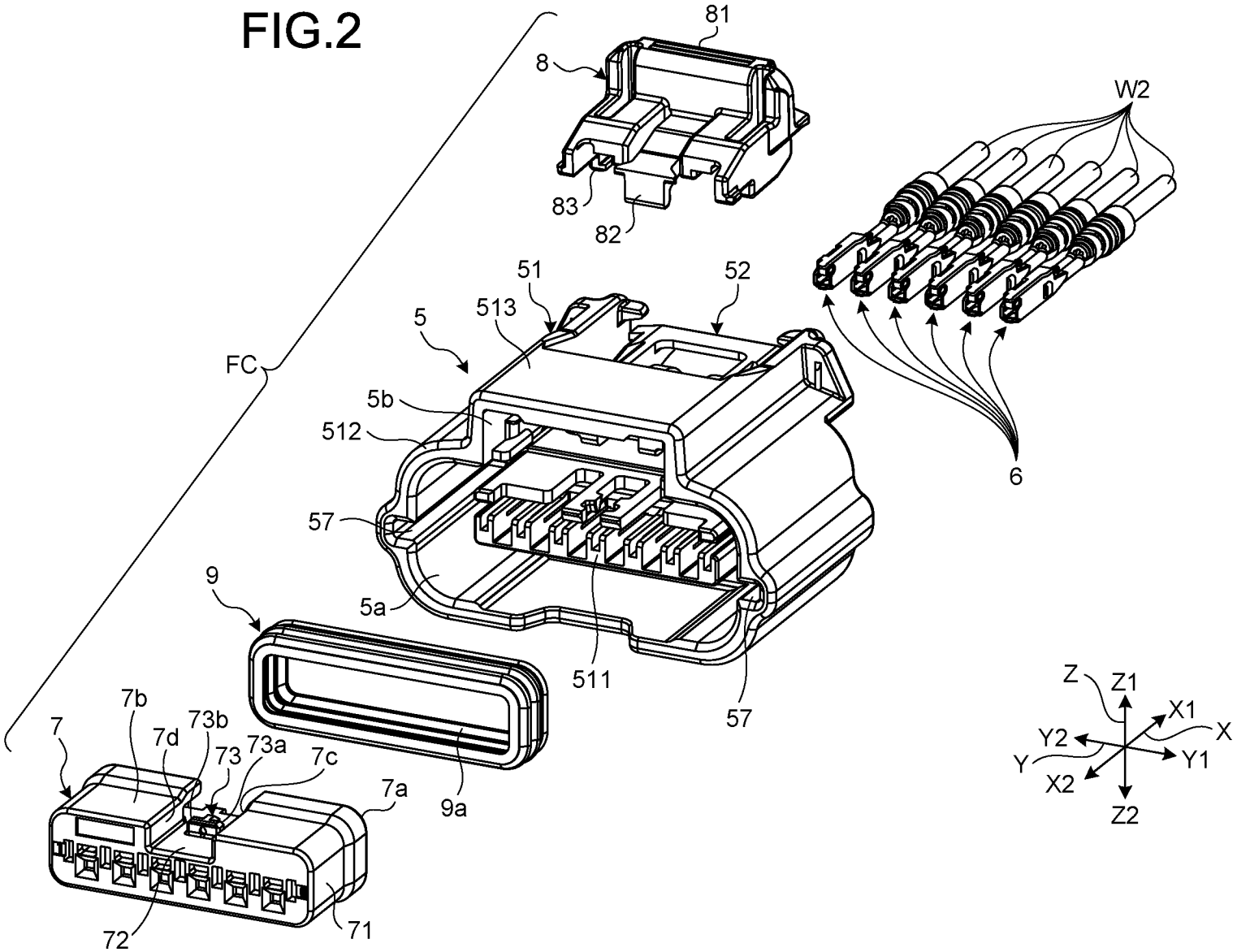
FIG. 2 is an exploded perspective view illustrating the connector according to the present embodiment.
Figure 3:
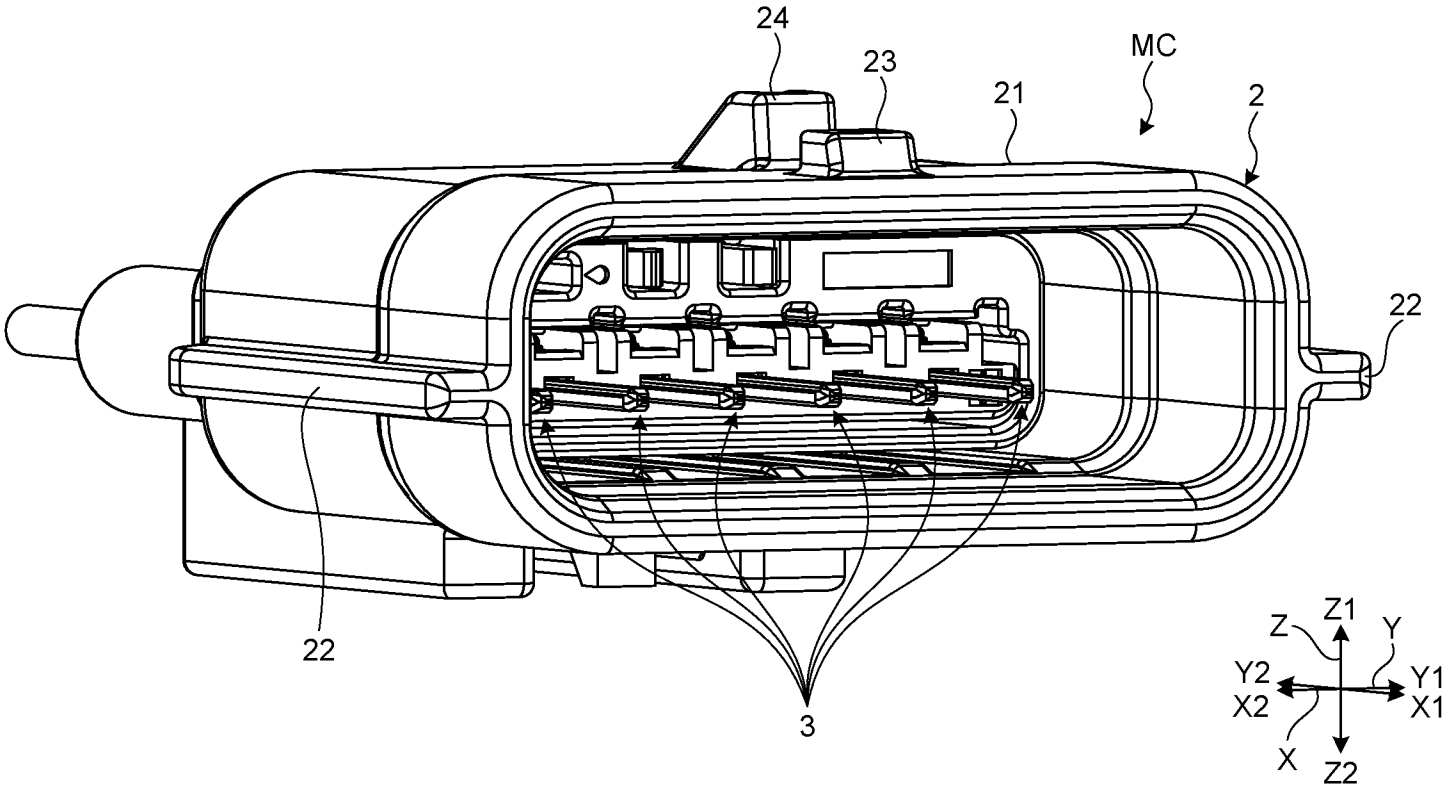
FIG. 3 is a perspective view illustrating a male connector.
Figure 4:
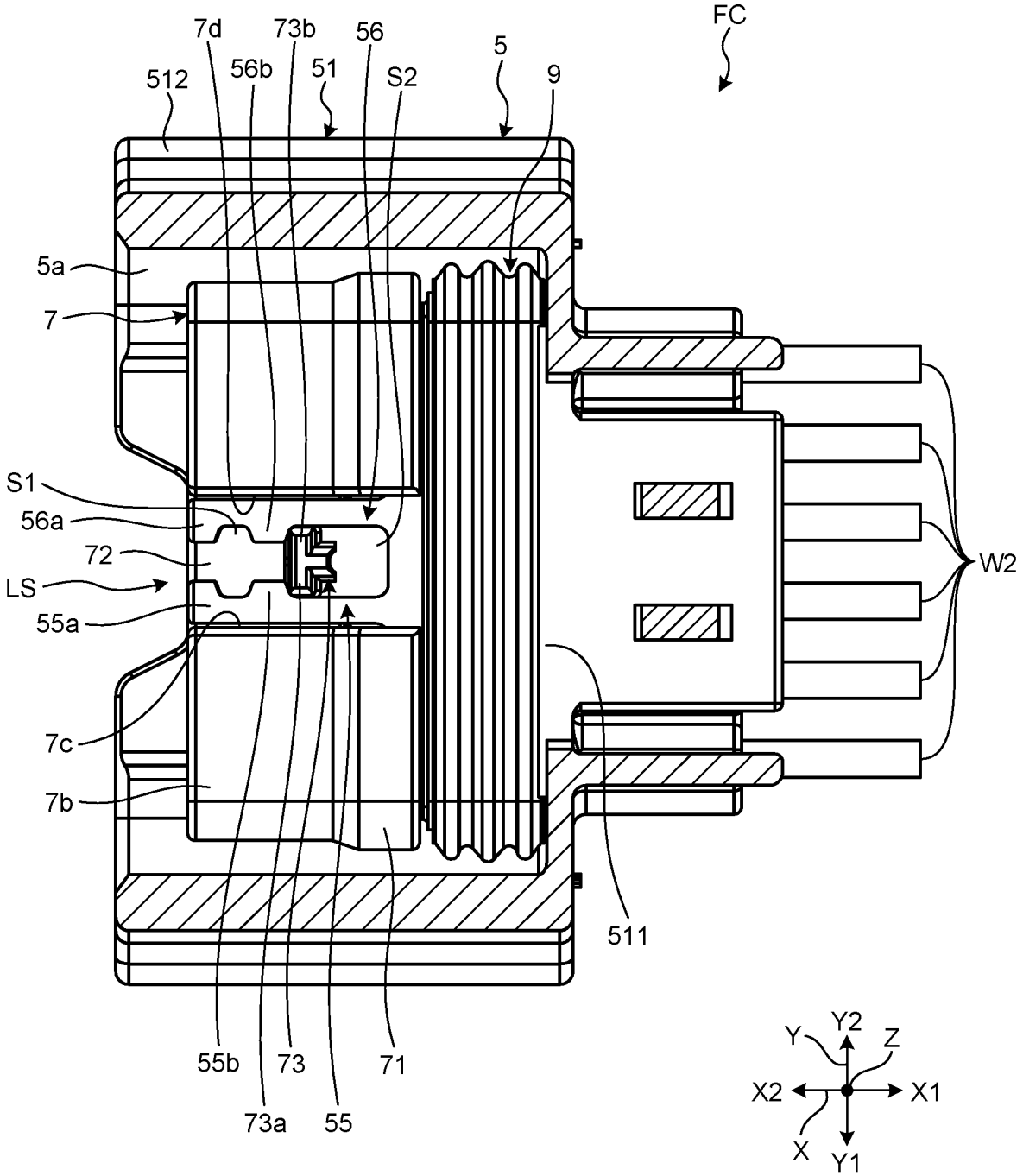
FIG. 4 is a partial cross-sectional plan view (fully locked state) of the connector according to the present embodiment.
Figure 5:
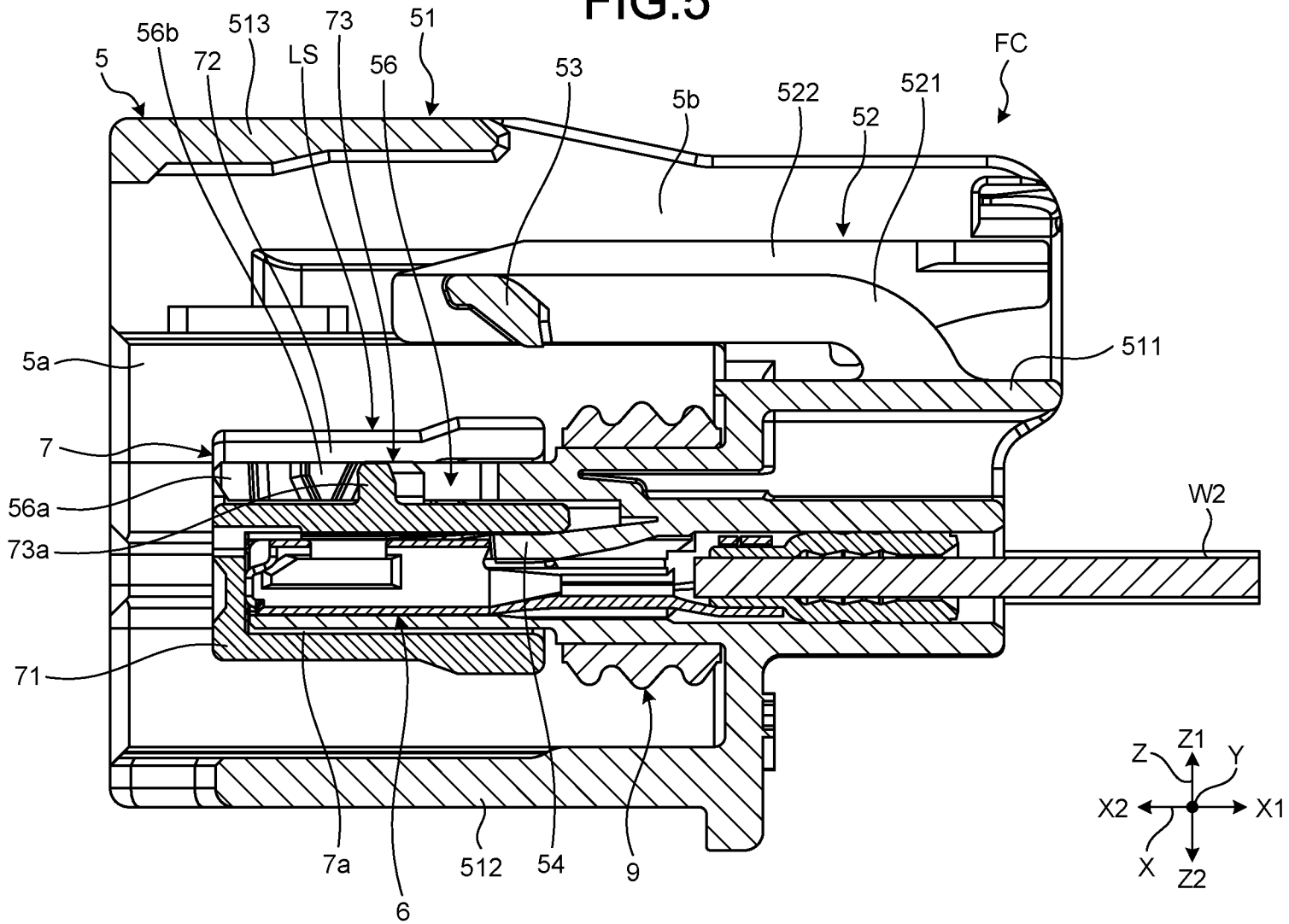
FIG. 5 is a cross-sectional view (fully locked state) of the connector according to the present embodiment.

FIG. 1 is a perspective view illustrating a CPA connector including a connector (female connector) according to the present embodiment. FIG. 2 is an exploded perspective view illustrating the connector (female connector) according to the present embodiment. FIG. 3 is a perspective view illustrating a male connector. FIG. 4 is a partial cross-sectional plan view (fully locked state) of the connector according to the present embodiment. FIG. 5 is a cross-sectional view (fully locked state) of the connector according to the present embodiment. Incidentally, FIG. 1 illustrates a state where elements constituting each of the male connector and the female connector are combined, and FIG. 2 illustrates a state where the respective elements constituting the female connector are disassembled. In addition, FIG. 4 (including FIGS. 6 and 8) illustrates the female housing in a partial cross section, and is a cross-sectional view taken along the line A-A of FIG. 1. FIG. 5 (including FIGS. 7 and 9 to 11) is a cross-sectional view taken along the line B-B of FIG. 1.

An X direction of FIGS. 1 to 5 (including FIGS. 6 to 13) is a fitting direction of a CPA connector 1 according to the present embodiment, and is a front-rear direction of a male connector MC and a female connector FC. A Y direction is a second direction, is orthogonal to the fitting direction, and is a width direction of the connector 1 according to the present embodiment. A Z direction is a first direction, is orthogonal to the fitting direction and the second direction, and is a vertical direction of the CPA connector 1 according to the present embodiment. An X1 direction is an insertion direction, and an X2 direction is a detachment direction. A Y1 direction is a left direction, and a Y2 direction is a right direction. A Z1 direction is an upward direction, and a Z2 direction is a downward direction. Each direction used in the following description indicates a direction in a state where the respective parts are assembled to each other unless otherwise specified.

The CPA connector 1 according to the present embodiment is applied to, for example, a wire harness WH that is used in an automobile or the like. Here, the CPA connector 1 is a connection mechanism for wire-to-wire connection that connects an electric wire W1 and an electric wire W2 constituting the wire harness WH, and is used in, for example, an airbag circuit as illustrated in FIG. 1. Here, each of the electric wires W1 and W2 is configured to include, for example, a conductor portion (core wire) obtained by twisting a plurality of conductive metal strands and an insulating covering portion that covers the outer side of the conductor portion. The CPA connector 1 includes the male connector MC and the female connector FC. As the male connector MC and the female connector FC are fitted to each other to be joined as a connector, a male terminal 3 and a female terminal 6 respectively provided in the male connector MC and the female connector FC are electrically connected to each other, thereby forming electrically connecting portions in the CPA connector 1. Incidentally, the electric wires W1 and W2 are connected to the male terminal 3 and the female terminal 6, respectively, and a waterproof member is interposed between outer peripheries of the electric wires W1 and W2 and each terminal insertion chamber of a male housing 2 and terminal insertion chamber of a female housing 5 to be described later to ensure waterproofness.

As illustrated in FIGS. 1 and 3, the male connector MC is a male-type connector connected to an end of the electric wire W1 constituting the wire harness WH. The male connector MC according to the present embodiment is a mating connector. The male connector MC includes the male housing 2, the male terminal 3, and a front holder 4.

The male housing 2 is a mating connector housing, is a male-side connector housing, and is made of an insulating synthetic resin material or the like. The male housing 2 accommodates the male terminal 3, and includes a body portion 21, a male-side rib 22, a male beak 23, and a beak regulating portion 24.

The body portion 21 is formed in a substantially elongated cylindrical shape closed on the detachment direction side along the fitting direction, and a fitting space 2*a* is formed inside the body portion 21. The fitting space 2*a* is a space which communicates with the outside through an opening formed at an insertion-direction-side end of the body portion 21 and to which the female housing 5 of the female connector FC is fitted. The body portion 21 holds the male terminal 3 with the front holder 4 interposed therebetween such that the distal end (insertion-direction-side end) of the male terminal 3 is exposed inside the fitting space 2*a*.

The male-side rib 22 protrudes from an outer peripheral surface of the body portion 21 and is formed to extend in the fitting direction. The pair of male-side ribs 22 according to the present embodiment is formed at positions facing each other in the width direction on the outer peripheral surface of the body portion 21, and are inserted into a pair of support grooves 57, which will be described later, of the female housing 5 when the male connector MC and the female connector FC are fitted to each other to form the connector, thereby supporting the female housing 5 with respect to the male housing 2.

The male beak 23 protrudes from the outer peripheral surface of the body portion 21. The male beak 23 according to the present embodiment is formed in a substantially center portion in the width direction on a surface on the upward direction side of the outer peripheral surface of the body portion 21, in the vicinity of the insertion-direction-side end in the fitting direction. When the male beak 23 is viewed from the width direction, between surfaces facing each other in the fitting direction with a top portion therebetween, a surface on the insertion direction side is formed as an inclined surface protruding to the insertion direction side as proceeding toward the downward direction and a surface on the detachment direction side is formed as a locking surface parallel (including the state of being substantially parallel) to the vertical direction. The male beak 23 is configured to lock a female beak 53, which will be described later, of the female housing 5, thereby regulating movement of the female beak 53 to the insertion direction side in the locked state.

The beak regulating portion 24 is formed so as to protrude from the outer peripheral surface of the body portion 21. The beak regulating portion 24 according to the present embodiment is formed in a substantially center portion in the width direction on the surface on the side in the upward direction of the outer peripheral surface of the body portion 21 so as to face the male beak 23 in the fitting direction on the detachment direction side of the male beak 23. When the beak regulating portion 24 is viewed from the width direction, between surfaces facing each other in the fitting direction with a top portion therebetween, a surface on the insertion direction side is formed as a locking surface parallel (including the state of being substantially parallel) to the vertical direction, and a surface on the detachment direction side is formed as an inclined surface protruding to the detachment direction side as proceeding toward the downward direction. The beak regulating portion 24 is configured to lock the female beak 53, thereby regulating movement of the female beak 53 to the detachment direction side in the locked state.

The male terminal 3 is a mating terminal and is electrically connected to the female terminal 6 by being inserted into the female terminal 6. A plurality of the male terminals 3 is arranged in the width direction inside the male housing 2. The male terminal 3 is a male-type terminal fitting for a connector, and is connected to the end of the electric wire W1. The entire male terminal 3 is made of a conductive metal. The male terminal 3 extends along the fitting direction in the state of being held by the male housing 2. The male terminal 3 faces the front holder 4 in the fitting direction, and has the distal end protruding from the front holder 4 toward the fitting space 2*a* and an opposite end (detachment-direction-side end) to which the electric wire W1 is connected. Here, the terminal insertion chamber is formed to extend in the fitting direction, has an insertion-direction-side end communicating with the fitting space 2*a*, and communicates with the outside through an opening formed at a detachment-direction-side end of the body portion 21. The male terminal 3 is inserted into the terminal insertion chamber along the fitting direction through the opening communicating with the terminal insertion chamber formed at the detachment-direction-side end of the body portion 21 and locked by a lance (not illustrated), thereby being held by the male housing 2 in a state where the distal end thereof is exposed inside the fitting space 2*a* through the front holder 4.

The front holder 4 is attached to the insertion direction side of the male housing 2. The front holder 4 is inserted into the fitting space 2*a* of the male housing 2 and is locked with respect to the male housing 2 by a locking structure (not illustrated), thereby being held by the male housing 2. In the front holder 4, openings are formed to correspond respectively to the male terminals 3, which face the openings in the fitting direction, at the insertion-direction-side end, and the distal ends of the male terminals 3 protrude toward the fitting space 2*a* through the respective openings.

The female connector FC is a connector and is a female-type connector connected to an end of the electric wire W2 constituting the wire harness WH as illustrated in FIGS. 1, 2, 4, and 5. The female connector FC includes the female housing 5, the female terminal 6, a front holder 7, a CPA member 8, and a waterproof packing 9.

The female housing 5 is a connector housing, is a female-side connector housing, and is made of an insulating synthetic resin material or the like. The female housing 5 accommodates the female terminal 6 to which the male terminal 3 is connected, and is inserted into the fitting space 2*a* of the male housing 2 to be fittable with the male housing 2. The female housing 5 includes a body portion 51, a lock arm portion 52, a female beak 53, a lance 54, locking arms 55 and 56, and a support groove 57.

The body portion 51 is formed in a substantially elongated cylindrical shape closed on the insertion direction side along the fitting direction, has a part inserted into the fitting space 2*a* together with the front holder 7, and is a portion to be fitted with the male housing 2 when a part of the male housing 2 is inserted therein. A fitting space 5*a* and a CPA member moving space 5*b* are formed inside the body portion 51. The body portion 51 includes a first body portion 511, a second body portion 512, and a third body portion 513.

The first body portion 511 is formed in a rectangular shape and extends along the fitting direction when viewed from the fitting direction. The first body portion 511 holds the female terminal 6 via the front holder 7. A terminal insertion chamber corresponding to the female terminal 6 is formed in the first body portion 511. The terminal insertion chamber is a space which is formed to extend in the fitting direction and communicates with the outside through openings formed at both ends in the fitting direction of the first body portion 511, and into which the female terminal 6 is inserted in the fitting direction and held. A plurality of the terminal insertion chambers according to the present embodiment is formed in the width direction inside the first body portion 511 to correspond to the number of the plurality of female terminals 6 provided in the female housing 5.

The second body portion 512 is formed in a substantially elongated cylindrical shape closed on the insertion direction side along the fitting direction, and the fitting space 5*a* is formed therein. The fitting space 5*a* is a space which communicates with the outside through an opening formed at a detachment-direction end of the second body portion 512 and to which the male housing 2 of the male connector MC is fitted.

The third body portion 513 is formed in a rectangular shape having an opening formed on the downward direction side along the fitting direction, communicates with the outside through openings formed at both ends in the fitting direction, and is formed to communicate with the outside through an opening formed on the upward direction side of an insertion-direction-side end. The CPA member moving space 5*b* is formed inside the third body portion 513. The CPA member moving space 5*b* is a space that allows the CPA member 8 to be inserted therein and supports the CPA member 8 to be movable in the fitting direction.

The lock arm portion 52 is configured to support the female beak 53 with respect to the body portion 51 in the state of being apart in the vertical direction. The lock arm portion 52 includes a first arm portion 521 and a second arm portion 522. The first arm portion 521 is formed in a U shape open on the insertion direction side when viewed from the vertical direction. Both ends of the first arm portion 521 on the insertion direction side are connected to the first body portion 511, and the first arm portion 521 supports the lock arm portion 52 with respect to the body portion 51 to be elastically deformable. The female beak 53 is formed in a center portion in the width direction of a detachment-direction-side end in the first arm portion 521. Accordingly, the first arm portion 521 elastically deforms in the vertical direction, thereby supporting the female beak 53 with respect to the first body portion 511 to be movable in the vertical direction. The second arm portion 522 is formed in a U shape open on the detachment direction side when viewed from the vertical direction. Both ends (two ends in the width direction) on the detachment direction side of the second arm portion 522 are connected to both the ends on the detachment direction side of the first arm portion 521, respectively. Guide rails are formed on both the ends in the width direction of the second arm portion 522 to protrude outward. The pair of guide rails according to the present embodiment is inserted between the CPA member 8 and a claw portion 83 as the claw portion 83, which will be described later, of the CPA member 8 is overlapped thereon during insertion of the CPA member 8 in which the CPA member 8 is inserted into the female housing 5, thereby supporting movement of the CPA member 8 in the fitting direction with respect to the female housing 5 while regulating movement of the CPA member 8 in the upward direction with respect to the female housing 5.

The female beak 53 constitutes a part of a locking structure to lock the female housing 5 to the male housing 2. The female beak 53 overrides the male beak 23 in a fitting state, is inserted between the male beak 23 and the beak regulating portion 24, and can lock the male beak 23 in the fitting direction. The female beak 53 according to the present embodiment is formed to protrude in the downward direction at a detachment-direction-side end of the lock arm portion 52. When the female beak 53 is viewed from the width direction, between surfaces facing each other in the fitting direction with a top portion therebetween, a surface on the insertion direction side is formed as a locking surface parallel (including the state of being substantially parallel) to the vertical direction, and a surface on the detachment direction side is formed as an inclined surface recessed to the insertion direction side as proceeding toward the downward direction.

The lance 54 constitutes a part of a locking structure to lock the female terminal 6 to the female housing 5. The lance 54 according to the present embodiment faces the female terminal 6 in the fitting direction, thereby regulating the female terminal 6 inside the terminal insertion chamber from moving in the insertion direction and locking the female terminal 6 inside the terminal insertion chamber. The lance 54 is formed in each of the terminal insertion chambers. The lance 54 is formed to protrude from a detachment-direction-side end of an upward-direction-side inner wall surface forming the terminal insertion chamber toward the downward direction as proceeding toward the detachment direction in the first body portion 511, and is supported to be elastically deformable with respect to the body portion 51.

The locking arms 55 and 56 constitute a part of a locking structure LS configured to lock the front holder 7 to the female housing 5, and are inserted between a locking protrusion 73, which will be described later, and regulating surfaces 7*c* and 7*d*. The locking structure LS according to the present embodiment is constituted by the locking arms 55 and 56, the locking protrusion 73, and the regulating surfaces 7*c* and 7*d*. The locking arms 55 and 56 according to the present embodiment are deformable members, and are provided on the female housing 5 which is the other of the female housing 5 and the front holder 7, and are formed to extend in the fitting direction. The locking arms 55 and 56 are formed to protrude from the body portion 51 in the detachment direction. The locking arms 55 and 56 are formed to protrude in the detachment direction at a recessed portion formed at a center portion in the upward direction of the detachment-direction-side end of the first body portion 511, and is supported to be elastically deformable with respect to the body portion 51. That is, the locking arms 55 and 56 are flexible as compared with the body portion 51, and are elastically deformable and elastically returnable in the vertical direction and the width direction. Therefore, the locking arms 55 and 56 can be elastically deformed in the vertical direction with respect to the female housing 5. The locking arms 55 and 56 are formed in the first body portion 511 in the state of being spaced apart from each other in the width direction. The locking arms 55 and 56 have temporary locking portions 55*a* and 56*a* and full locking portions 55*b* and 56*b* as two locking portions.

The temporary locking portions 55*a* and 56*a* are formed to approach each other, that is, to protrude inward from surfaces of the locking arms 55 and 56, the surfaces where the locking arms 55 and 56 face each other in the width direction. The full locking portions 55*b* and 56*b* are formed to approach each other, that is, to protrude inward from surfaces of the locking arms 55 and 56, the surfaces where the locking arms 55 and 56 face each other in the width direction. The temporary locking portions 55*a* and 56*a* are formed at detachment-direction-side ends of the locking arms 55 and 56, respectively. The full locking portions 55*b* and 56*b* are formed on the insertion direction side of the temporary locking portions 55*a* and 56*a* while being apart from the temporary locking portions 55*a* and 56*a* in the locking arms 55 and 56, respectively. Here, each of the locking portions 55*a*, 56*a*, 55*b*, and 56*b* is formed such that at least a part thereof overlaps with the locking protrusion 73 when viewed from the fitting direction in a state where each of the locking arms 55 and 56 is inserted between the locking protrusion 73 and each of the regulating surfaces 7*c* and 7*d*. When the locking portions 55*a*, 56*a*, 55*b*, and 56*b* are viewed from the vertical direction, between surfaces facing each other in the fitting direction with a top portion therebetween, a surface on the insertion direction side is formed as an inclined surface protruding to the insertion direction side as proceeding toward a direction in which the locking arms 55 and 56 are separated from each other in the width direction. Therefore, when the female housing 5 is pulled out from a mold on the detachment direction side between molds divided into two in the fitting direction in manufacturing the female housing 5, the locking arms 55 and 56 are guided in the direction of being separated from each other in the width direction by the inclined surface so that it is possible to improve removal performance when pulling out the female housing 5 from the mold. When the temporary locking portions 55*a* and 56*a* are viewed from the width direction, between surfaces facing each other in the fitting direction across a bottom portion, a surface on the detachment direction side is formed as an inclined surface recessed to the insertion direction side as proceeding toward the downward direction, and a surface on the insertion direction side is formed as a locking surface parallel (including the state of being substantially parallel) to the vertical direction. In addition, when the full locking portions 55*b* and 56*b* are viewed from the width direction, between surfaces facing each other in the fitting direction across a bottom portion, a surface on the detachment direction side is formed as an inclined surface recessed to the insertion direction side as proceeding toward the downward direction, and a surface on the insertion direction side is formed as an inclined surface recessed to the detachment direction side as proceeding toward the downward direction. Incidentally, a temporary locking space S1 in which the locking protrusion 73 is temporarily locked between the temporary locking portions 55*a* and 56*a* and the full locking portions 55*b* and 56*b*, and a full locking space S2 in which the locking protrusion 73 is fully locked between the full locking portions 55*b* and 56*b* and the detachment-direction-side end of the first body portion 511 are formed between the locking arms 55 and 56.

The support groove 57 is formed along the extending direction inside the fitting space 5*a*. A plurality of the support grooves 57 is formed to correspond to the pair of male-side ribs 22.

The female terminal 6 is electrically connected to the male terminal 3 as the male terminal 3 is inserted therein. A plurality of the female terminals 6 is arranged in the width direction inside the female housing 5. The female terminal 6 is a female-type terminal fitting for a connector, and is connected to the end of the electric wire W2. The entire female terminal 6 is made of a conductive metal. The female terminal 6 extends in the fitting direction while being held by the female housing 5. The female terminal 6 has a distal end facing the front fork 79 in the fitting direction and an end (insertion-direction-side end) opposite to the distal end is connected with the electric wire W2. The female terminal 6 is inserted into a terminal insertion chamber along the fitting direction from an opening formed at the insertion portion side end of the first body portion 511 and locked by the lance 54, thereby being held by the female housing 5. The female terminal 6 has an insertion space formed therein. The insertion space is a space which is formed to extend in the fitting direction and communicates with the outside through the opening formed on the detachment direction side of the female terminal 6, and into which the distal end of the male terminal 3 is inserted in the fitting direction and held. When the female terminal 6 is viewed from the extending direction, a wall portion on the upward direction side is formed to face the lance 54 among wall portions forming the insertion space. As the insertion-direction-side end and a detachment-direction-side end of the lance 54 come into contact with each other on the wall surface on the upward direction side, the female terminal 6 is locked by the lance 54.

The front holder 7 is configured to allow a part of the female housing 5 to be inserted therein, thereby regulating the movement of the female terminal 6 in the detachment direction. The front holder 7 is attached to the detachment-direction-side end of the first body portion 511 to cover the detachment direction side of the first body portion 511. The front holder 7 includes a body portion 71, a recessed portion 72, and the locking protrusion 73.

The body portion 71 is formed in a substantially rectangular tubular shape with a detachment-direction-side end closed along the fitting direction, and has an insertion space 7*a* into which the detachment-direction-side end of the first body portion 511 is inserted formed therein. The body portion 71 is held as the female housing 5 is inserted into the insertion space 7*a* and locked to the female housing 5 by the locking structure LS. Openings are formed in the body portion 71 at the detachment-direction-side end so as to correspond to the respective female terminals 6 facing the openings in the fitting direction.

The recessed portion 72 is formed by causing a part of the body portion 71 to be recessed inward. That is, the front holder 7 is formed by causing a part of an outer peripheral surface 7*b* to be recessed toward the insertion space 7*a*. Both ends of the recessed portion 72 in the fitting direction communicate with the outside, and side surfaces facing each other in the width direction, which constitute the recessed portion 72, are the regulating surfaces 7*c* and 7*d*. Here, the regulating surfaces 7*c* and 7*d* are provided to be apart from each other to face the locking protrusions 73 in the width direction, and regulate the locking arms 55 and 56, respectively, from moving in the width direction when each of the locking arms 55 and 56 face the locking protrusions 73 in the width direction. The regulating surfaces 7*c* and 7*d* according to the present embodiment are formed to have a length in the width direction that is the same as (slightly longer than) a length of the locking arms 55 and 56 in the width direction (a length from a side surface facing the regulating surface 7*c* of the locking arm 55 to a side surface facing the regulating surface 7*d* of the locking arm 56). In addition, the regulating surfaces 7*c* and 7*d* are formed to have a length in the vertical direction, that is, a depth of the recessed portion 72 such that the locking arms 55 and 56 to be inserted into the recessed portion 72 do not protrude from the upward-direction-side end of the recessed portion 72 in a state where the front holder 7 is attached to the female housing 5. Therefore, the locking arms 55 and 56 are inserted into the recessed portion 72 when being inserted between the locking protrusions 73 and the regulating surfaces 7*c* and 7*d*, and thus, it is possible to prevent the locking structure LS from protruding to the outer side in the vertical direction of the outer peripheral surface 7*b* of the front holder 7, which covers a part of the female housing 5, even if the locking structure LS is provided to lock the female housing 5 and the front holder 7. As a result, it is possible to suppress a size increase of the female connector FC in the vertical direction, and to suppress a size increase of the CPA connector 1 in the vertical direction. In addition, a worker can visually confirm the locked state obtained by the locking structure LS from the outside of the front holder 7, and thus, can visually confirm assembly failure in an easy manner.

The locking protrusion 73 constitutes a part of the locking structure LS that locks the front holder 7 to the female housing 5. The locking protrusion 73 according to the present embodiment is provided on the front holder 7 which is one of the female housing 5 and the front holder 7 and is formed so as to protrude in the vertical direction orthogonal to the fitting direction. The locking protrusion 73 is inserted between the pair of locking arms 55 and 56. The locking protrusion 73 is formed so as to protrude in the upward direction in a portion of the recessed portion 72 of the outer peripheral surface 7*b*, that is, in the recessed portion 72. When viewed from the vertical direction, the locking protrusion 73 is formed to extend in the fitting direction, has a detachment-direction-side end protruding to both ends in the width direction, and is formed with a first locking protruding portion 73*a* corresponding to the locking arm 55 and a second locking protruding portion 73*b* corresponding to the locking arm 56. When each of the locking protruding portions 73*a* and 73*b* is viewed from the width direction, between surfaces facing each other in the fitting direction with a top portion therebetween, a surface on the detachment direction side is formed as a locking surface parallel (including the state of being substantially parallel) to the vertical direction, and a surface on the insertion direction side is formed as an inclined surface partially recessed to the insertion direction side as proceeding toward the downward direction. That is, the locking protrusion 73 is formed in a T-shape when viewed from the vertical direction.

The CPA member 8 is a member configured to detect complete fitting between the male housing 2 and the female housing 5, and is a member configured to realize a so-called connector position assurance (CPA) function. The CPA member 8 is inserted into the CPA member moving space 5*b* of the female housing 5 and is assembled to the female housing 5 so as to be relatively movable in the fitting direction with respect to the female housing 5. The CPA member 8 is formed using an insulating synthetic resin material or the like, and has a body portion 81, a CPA lock portion 82, and the claw portion 83.

The body portion 81 is formed in a U shape open on the detachment direction side when viewed from the vertical direction. The body portion 81 is formed such that an insertion-direction-side end thereof protrudes to the upward direction side, and an operation surface (not illustrated) is formed thereon.

The CPA lock portion 82 constitutes a part of a locking structure to lock the CPA member 8 to the female housing 5. The CPA lock portion 82 is formed such that a detachment-direction-side end thereof protrudes to the downward direction side, an insertion-direction-side end thereof is connected to the body portion 81, and the detachment-direction-side end is supported to be elastically deformable in the vertical direction. In the fitting state, the CPA lock portion 82 can be locked to the beak regulating portion 24 at a fitting-guaranteed position by sequentially overriding the male beak 23, the female beak 53 locked to the male beak 23, and the beak regulating portion 24 sandwiching the female beak 53 together with the male beak 23 as the CPA member 8 moves from an initial position to the fitting-guaranteed position with respect to the female housing 5 in the detachment direction.

The waterproof packing 9 is interposed in a gap between the male housing 2 and the female housing 5 in the fitting state, thereby suppressing entry of liquid such as water into the fitting space 2*a* from the outside. The waterproof packing 9 is formed in a ring shape, and the first body portion 511 of the female housing 5 is inserted along the fitting direction into an insertion space 9*a* formed inside the waterproof packing 9.

Next, assembling, that is, fitting of the CPA connector 1 will be described. In particular, the holding of the front holder 7 with respect to the female housing 5 according to the embodiment will be described. First, assembling of the male connector MC will be described. The male terminals 3 to which the electric wires W1 are connected are inserted into the terminal insertion chambers, respectively, from the opening formed at the detachment-direction-side end of the body portion 21, the respective inserted male terminals 3 are locked by the lances, and the respective male terminals 3 are held inside the male housing 2, thereby assembling the respective male terminals 3 to the male housing 2. Next, the front holder 4 is inserted into the fitting space 2*a* from the insertion-direction-side end of the male housing 2, and the front holder 4 is held in the body portion 21 inside the fitting space 2*a*, thereby assembling the front holder 4 to the male housing 2.

Figure 6:
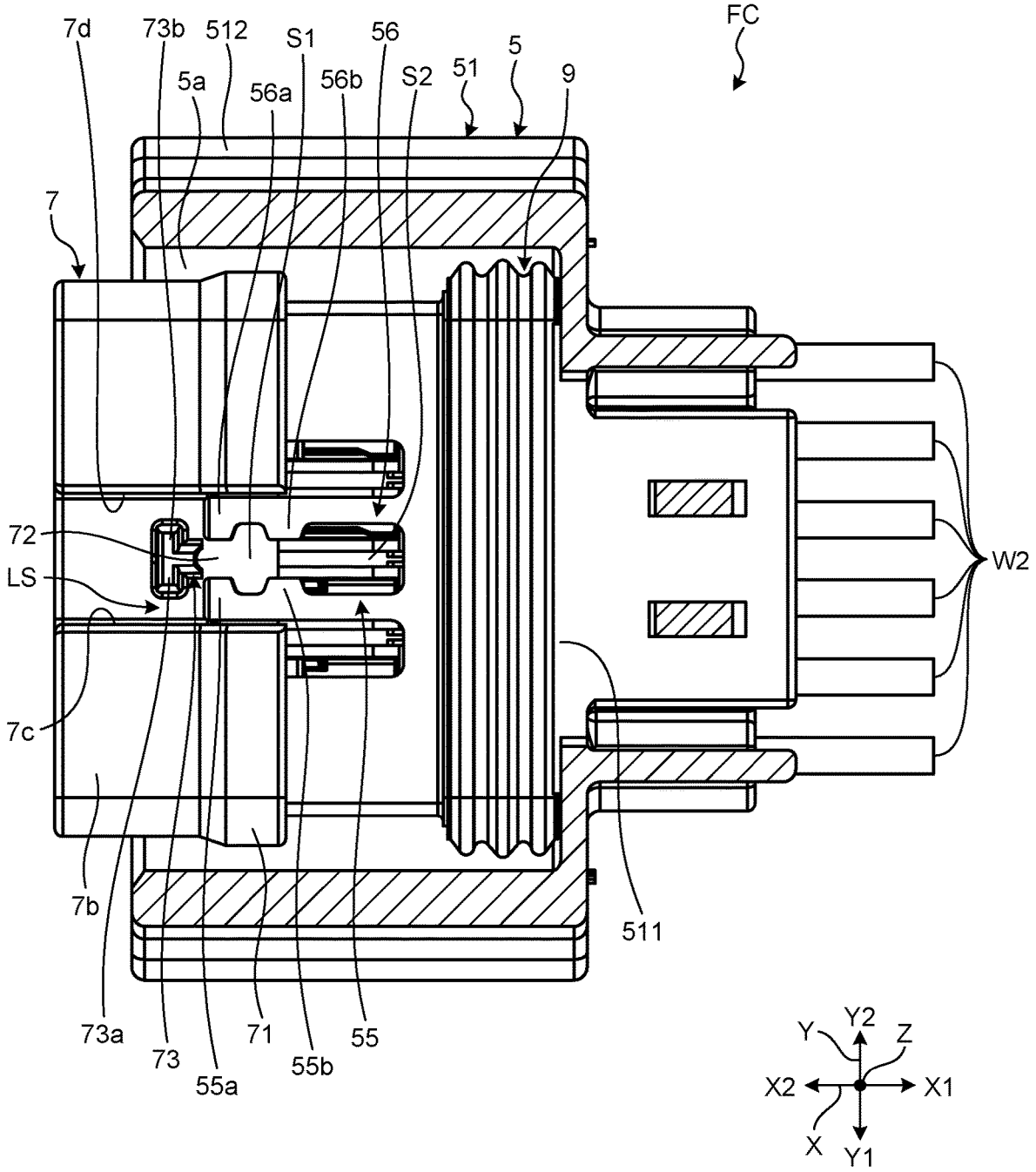
FIG. 6 is a partial cross-sectional plan view (state before assembling) of the connector according to the present embodiment.
Figure 7:
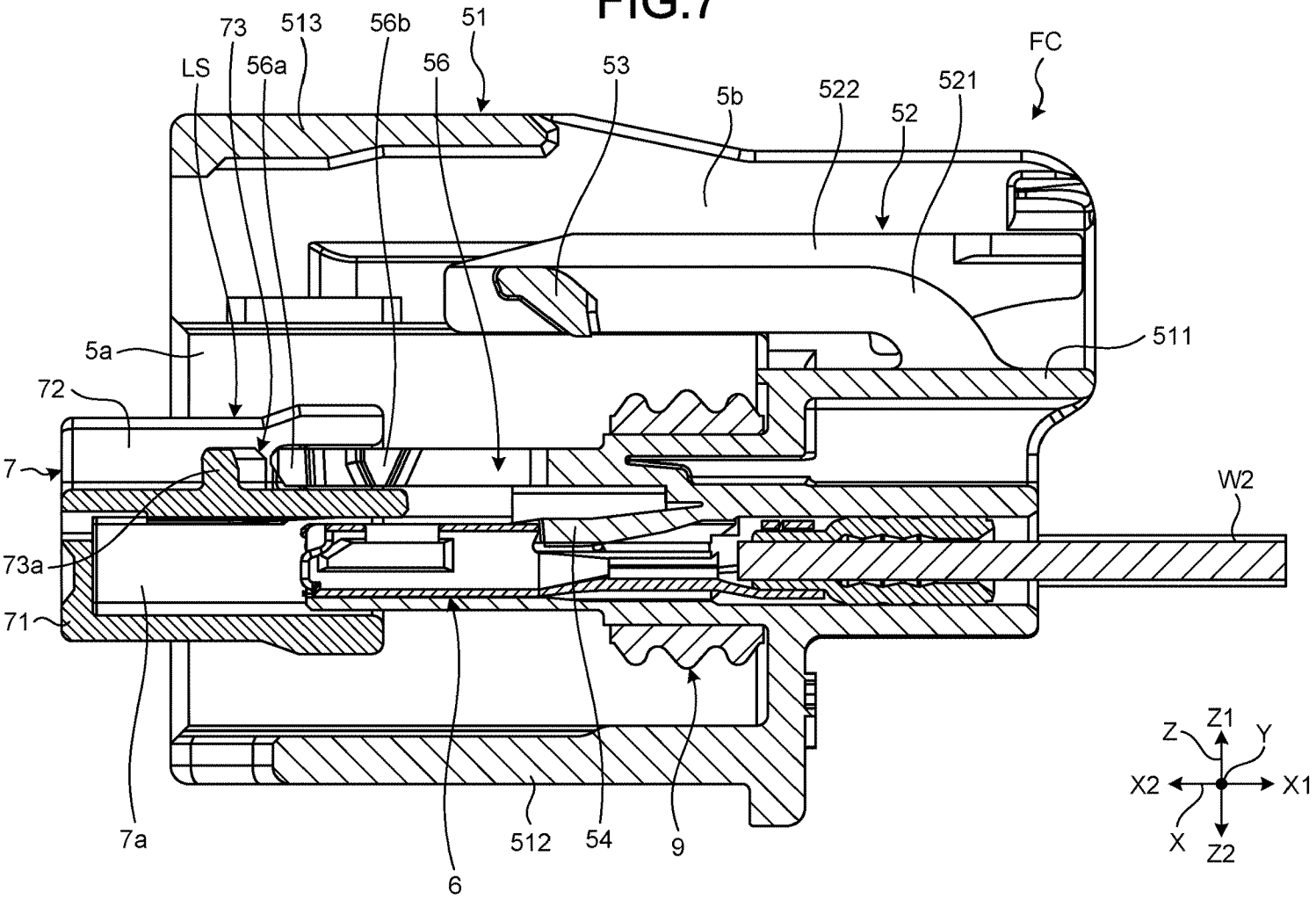
FIG. 7 is a cross-sectional view (state before assembling) of the connector according to the present embodiment.
Figure 8:
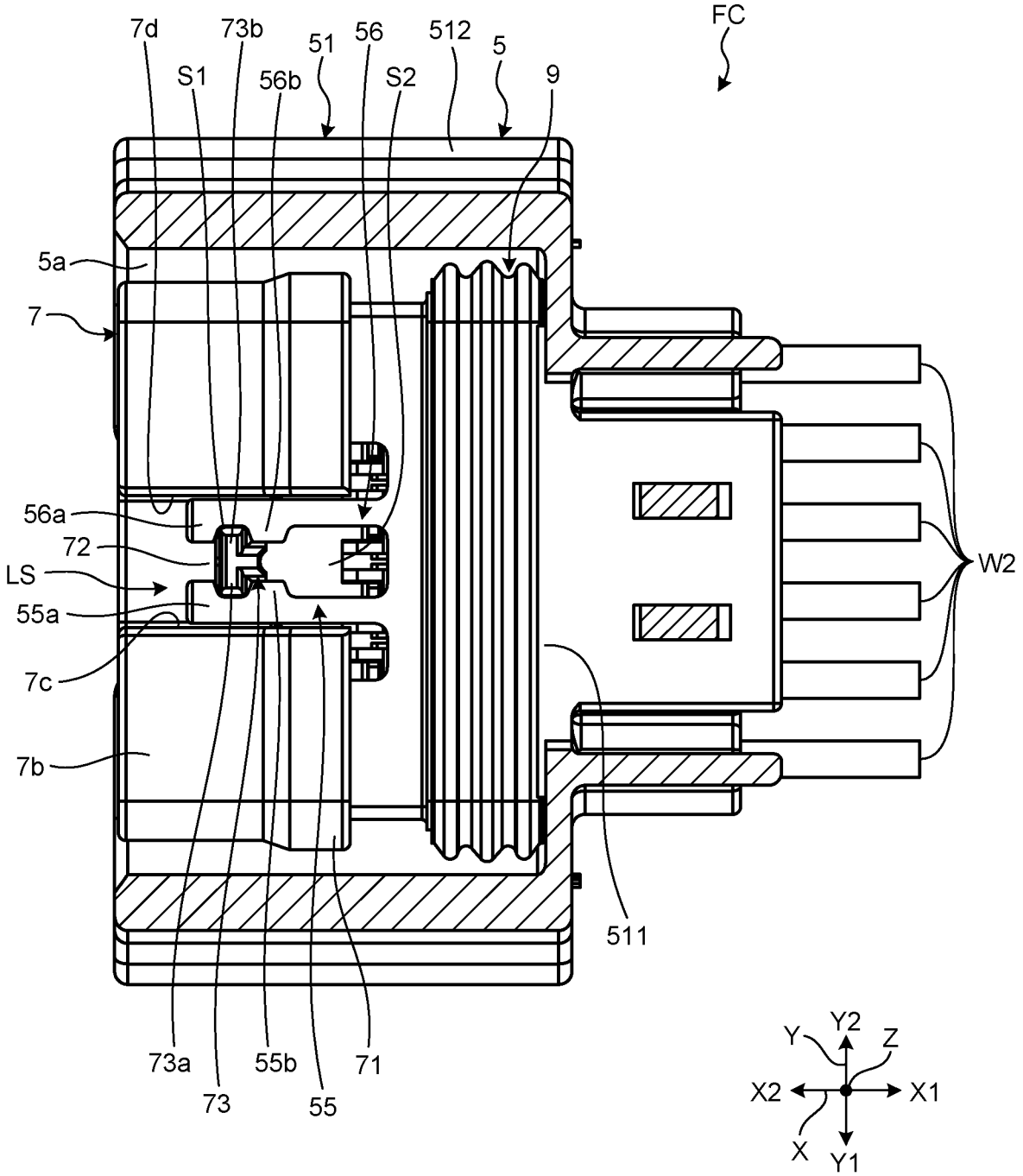
FIG. 8 is a partial cross-sectional plan view (temporarily locked state) of the connector according to the present embodiment.
Figure 9:
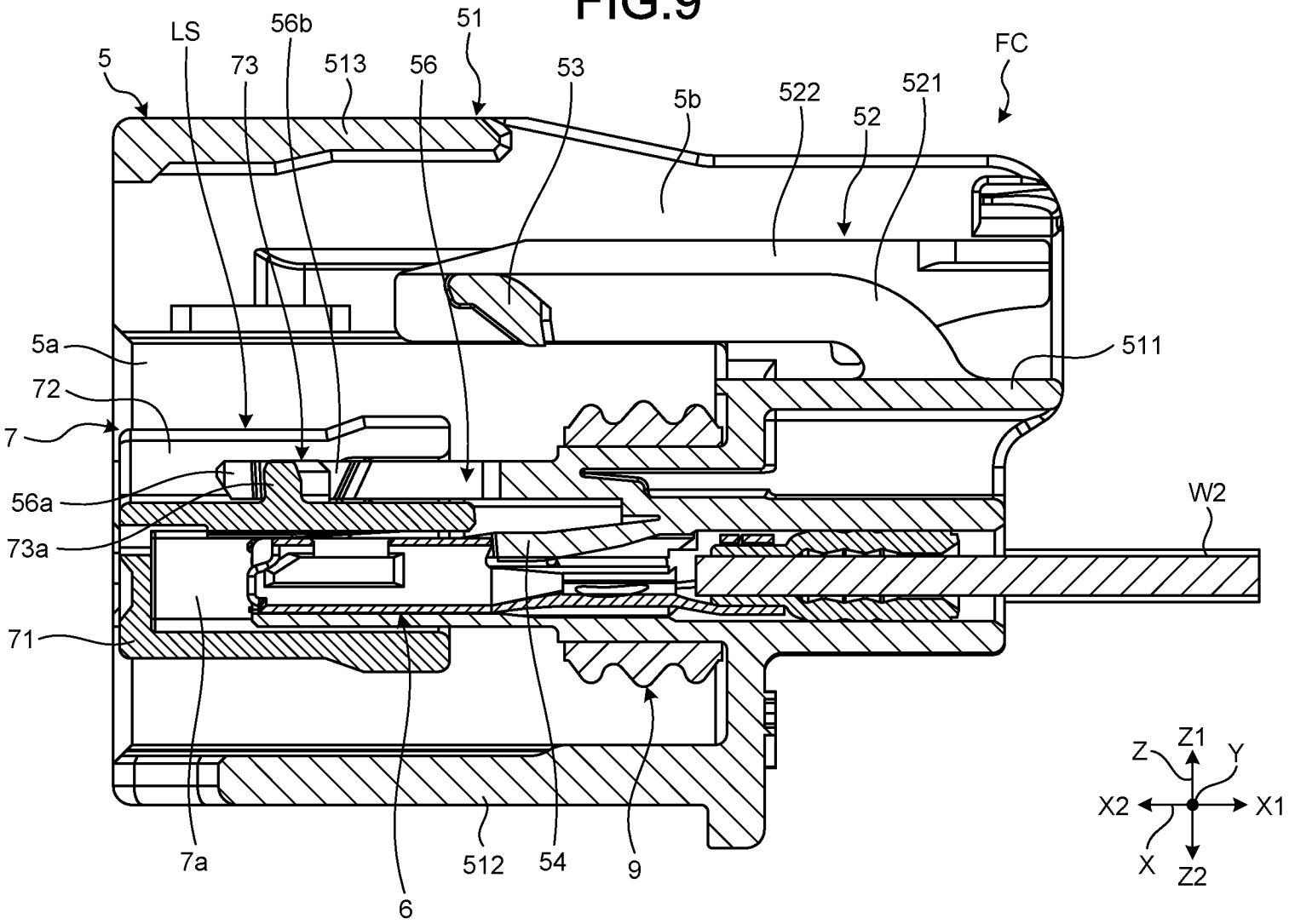
FIG. 9 is a cross-sectional view (temporarily locked state) of the connector according to the present embodiment.
Figure 10:
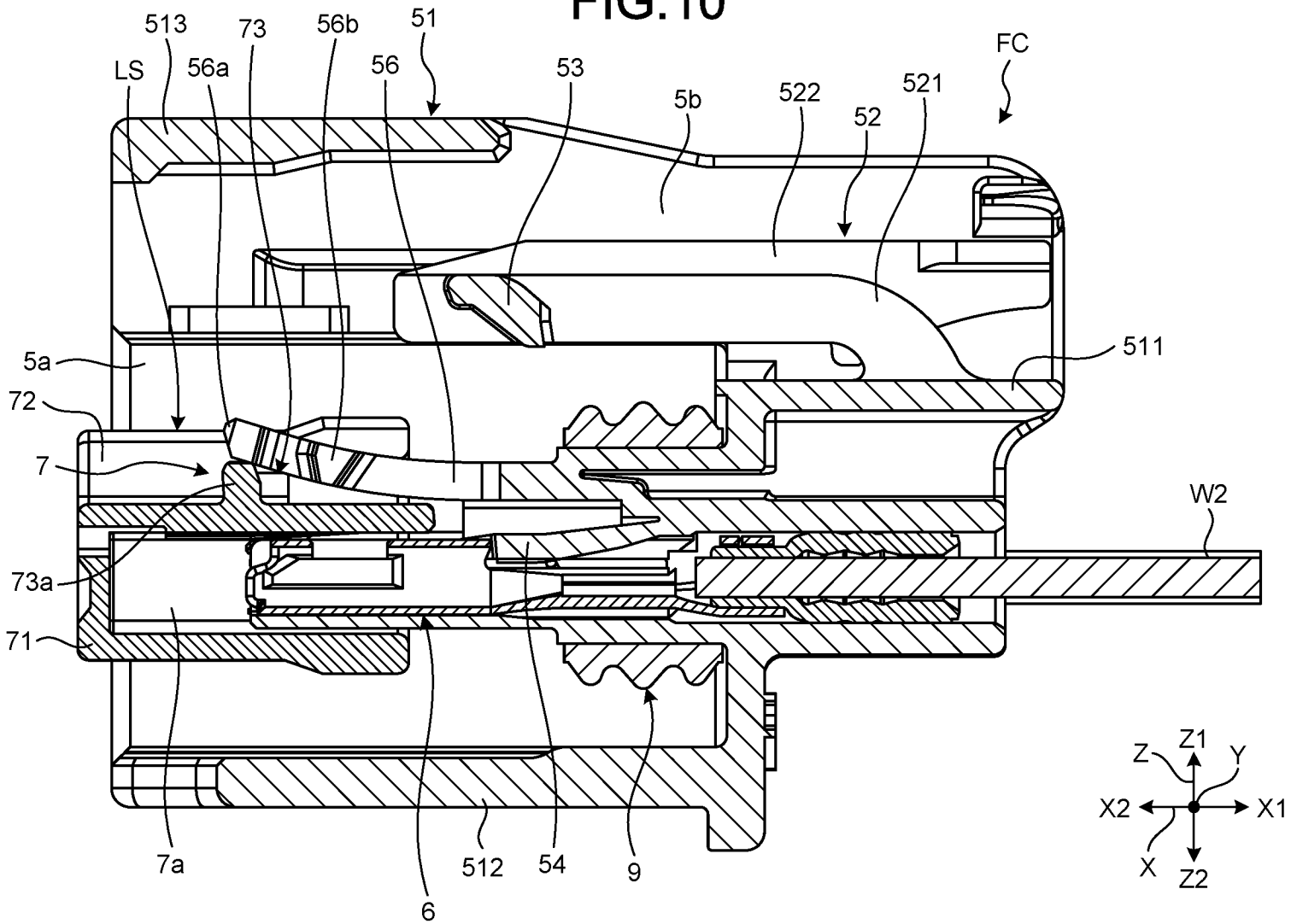
FIG. 10 is a cross-sectional view (state of overriding a temporary locking portion) of the connector according to the present embodiment.
Figure 11:
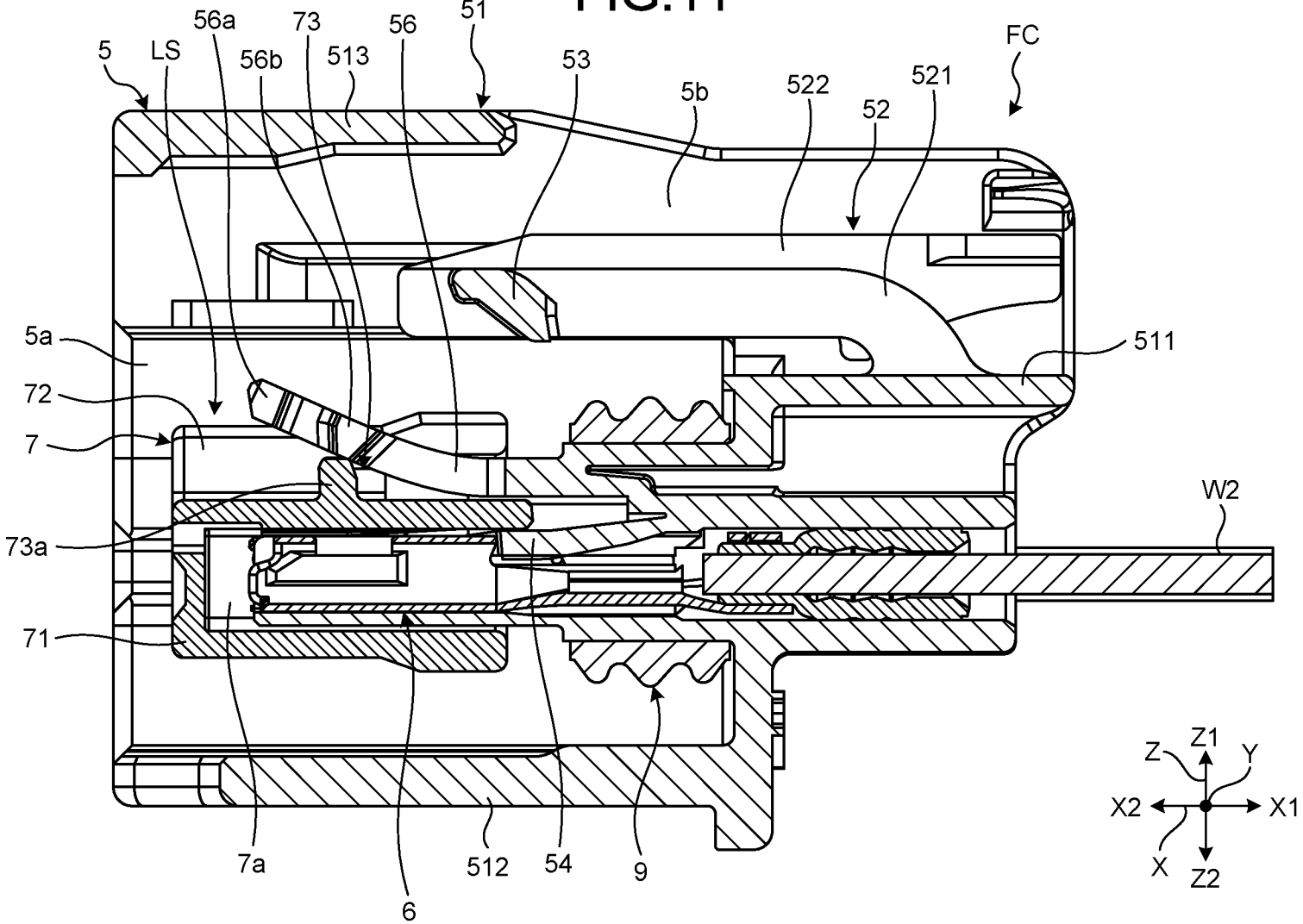
FIG. 11 is a cross-sectional view (state of overriding a full locking portion) of the connector according to the present embodiment.

Next, assembling of the female connector FC will be described. FIG. 6 is a partial cross-sectional plan view (state before assembling) of the connector according to the present embodiment. FIG. 7 is a cross-sectional view (state before assembling) of the connector according to the present embodiment. FIG. 8 is a partial cross-sectional plan view (temporarily locked state) of the connector according to the present embodiment. FIG. 9 is a cross-sectional view (temporarily locked state) of the connector according to the present embodiment. FIG. 10 is a cross-sectional view (state of overriding a temporary locking portion) of the connector according to the present embodiment. FIG. 11 is a cross-sectional view (state of overriding a full locking portion) of the connector according to the present embodiment.

First, the female terminals 6 to which the electric wires W2 are connected are inserted into the terminal insertion chambers, respectively, from the opening formed at the insertion-direction-side end of the first body portion 511. At this time, the respective female terminals 6 face the respective lances 54 in the fitting direction. Next, the waterproof packing 9 is inserted into the fitting space 5*a* from the detachment-direction-side end of the second body portion 512, and the first body portion 511 is inserted into the insertion space 9*a* to hold the waterproof packing 9 by the first body portion 511, thereby assembling the waterproof packing 9 to the female housing 5.

Next, the front holder 7 is arranged to face the first body portion 511 in the fitting direction, and the first body portion 511 is inserted into the insertion space 7*a* of the front holder 7 from the detachment-direction-side end as illustrated in FIGS. 6 and 7. At this time, the locking arms 55 and 56 are inserted into the recessed portion 72 at the detachment-direction-side ends, and the locking protrusion 73 faces the temporary locking portions 55*a* and 56*a* in the fitting direction. Next, when the front holder 7 is moved in the insertion direction with respect to the first body portion 511, that is, the front holder 7 is further inserted, the temporary locking portion 55*a* and the first locking protruding portion 73*a* of the locking protrusion 73 come into contact with each other and the temporary locking portion 56*a* and the second locking protruding portion 73*b* of the locking protrusion 73 come into contact with each other. Next, when the front holder 7 is further inserted, the locking arms 55 and 56 are elastically deformed in the upward direction with the insertion-direction-side end as a base point as illustrated in FIG. 10 when the temporary locking portions 55*a* and 56*a* face the locking protrusions 73 in the width direction. Next, when the front holder 7 is further inserted, the locking arms 55 and 56 move in the detachment direction with respect to the respective locking protruding portions 73*a* and 73*b* in the state of being elastically deformed in the upward direction so that the temporary locking portions 55*a* and 56*a* override the locking protrusions 73 as illustrated in FIGS. 8 and 9. At this time, when viewed from the vertical direction, the locking protrusion 73 is positioned inside the temporary locking space S1, and is sandwiched between the temporary locking portions 55*a* and 56*a* and the full locking portions 55*b* and 56*b* so that the front holder 7 is turned into a temporarily locked state with respect to the female housing 5. Next, when the front holder 7 is further inserted, the locking arms 55 and 56 are elastically deformed in the upward direction with the insertion-direction-side end as a base point as illustrated in FIG. 11 when the full locking portions 55*b* and 56*b* face the locking protrusions 73 in the width direction. Next, when the front holder 7 is further inserted, the locking arms 55 and 56 move in the detachment direction with respect to the respective locking protruding portions 73*a* and 73*b* in the state of being elastically deformed in the upward direction so that the full locking portions 55*b* and 56*b* override the locking protrusions 73 as illustrated in FIGS. 4 and 5. At this time, when viewed from the vertical direction, the locking protrusion 73 is positioned inside the full locking space S2, and is sandwiched between the full locking portions 55*b* and 56*b* and the detachment-direction-side end of the first body portion 511 such that the front holder 7 is turned into a fully locked state with respect to the female housing 5. In the fully locked state, the body portion 71 is positioned on the upward direction side of the lance 54, and faces the lance 54 in the upward direction. Therefore, the lance 54 is regulated from being elastically deformed in the upward direction, and thus, the respective female terminals 6 are locked by the respective lances 54, and the respective female terminals 6 are held inside the female housing 5, thereby assembling the respective female terminals 6 to the female housing 5.

Next, the CPA member 8 is inserted into the CPA member moving space 5*b* of the female housing 5, thereby assembling the CPA member 8 to the female housing 5. At this time, the pair of claw portions 83 of the CPA member 8 overlaps the pair of guide rails of the lock arm portion 52, and the CPA member 8 is assembled in the state of being movable between the initial position and the fitting-guaranteed position with respect to the female housing 5.

Next, the male connector MC is assembled to the female connector FC. First, the first body portion 511 of the female housing 5 is inserted into the fitting space 2*a* of the male housing 2 in a state where the CPA member 8 is at the initial position, and the male housing 2 is inserted into the fitting space 5*a* of the female housing 5. When the first body portion 511 is inserted into the fitting space 2*a*, the male beak 23 comes into contact with the female beak 53, the female beak 53 is elastically deformed in the upward direction, the female beak 53 overrides the male beak 23, and the female beak 53 enters between the male beak 23 and the beak regulating portion 24 in the fitting direction. Next, the CPA member 8 is moved in the fitting direction from the initial position located on the insertion direction side in the female housing 5 toward the fitting-guaranteed position, that is, the CPA member 8 is moved in the detachment direction with respect to the male housing 2 and the female housing 5. When the CPA member 8 is moved in the detachment direction, the CPA lock portion 82 comes into contact with the male beak 23, the CPA lock portion 82 is elastically deformed in the upward direction, and the CPA lock portion 82 overrides the male beak 23, overrides the female beak 53 between the male beak 23 and the beak regulating portion 24, and overrides the beak regulating portion 24 when the CPA member 8 is moved to the fitting-guaranteed position. In the CPA member 8, the CPA lock portion 82 is positioned on the detachment direction side, and the male beak 23 is positioned on the insertion direction side with the beak regulating portion 24 and the female beak 53 interposed therebetween, so that the CPA connector 1 is turned into a fitting-guaranteed state.

As described above, according to the female connector FC of the present embodiment, a regulating direction in which the locking arms 55 and 56 are regulated by the regulating surfaces 7*c* and 7*d* in the temporarily locked state and the fully locked state is different from a direction in which the locking portions 55*a*, 55*b*, 56*a*, and 56*b* override the locking protruding portions 73*a* and 73*b* when shifting to the temporarily locked state and the fully locked state, in the locking structure LS which locks the front holder 7 with respect to the female housing 5. Accordingly, the direction in which the respective locking portions 55*a*, 55*b*, 56*a*, and 56*b* override the respective locking protruding portions 73*a* and 73*b* in the locking arms 55 and 56 is set to a direction (the vertical direction in the present embodiment) not regulating each elastic deformation of the locking arms 55 and 56 so that each of the locking arms 55 and 56 is not forcibly inserted between the locking protrusions 73 and each of the regulating surfaces 7*c* and 7*d*, and thus, it is possible to suppress wear of each of the locking portions 55*a*, 55*b*, 56*a*, and 56*b* and each of the locking protruding portions 73*a* and 73*b*. As a result, it is possible to suppress a decrease of a holding force generated by the locking structure LS.

Further, the female connector FC according to the present embodiment is formed by the mold divided at least in the fitting direction. Here, since the locking portions 55*a*, 55*b*, 56*a*, and 56*b* are formed, the locking arms 55 and 56 are forcibly pulled out, that is, forcibly removed when the mold forming the locking arms 55 and 56 is pulled out in the detachment direction with respect to the locking arms 55 and 56. Thus, the locking portions 55*a*, 56*a*, 55*b*, and 56*b* are guided by the inclined surfaces in directions in which the locking arms 55 and 56 are separated from each other in the width direction. That is, in the case where the direction in which the respective locking protruding portions 73*a* and 73*b* override the respective locking portions 55*a*, 55*b*, 56*a*, and 56*b* is set to the width direction, it is difficult to change a shape of each of the locking portions 55*a*, 55*b*, 56*a*, and 56*b* in order to adjust a locking force since each of the locking portions 55*a*, 55*b*, 56*a*, and 56*b* is formed in the shape considering the forcible removal. On the other hand, in the female connector FC according to the present embodiment, the direction in which the respective locking protruding portions 73*a* and 73*b* override the respective locking portions 55*a*, 55*b*, 56*a*, and 56*b* is different from the fitting direction which is the direction for performing the forcible removal, and thus, it is possible to adjust the locking force and to ensure a high locking force.

In addition, in the temporarily locked state and the fully locked state of the locking structure LS, the pair of locking arms 55 and 56 is arranged between the pair of regulating surfaces 7*c* and 7*d*, and the locking protrusion 73 is arranged between the pair of locking arms 55 and 56. That is, the pair of locking arms 55 and 56 in the state of sandwiching the locking protrusion 73 is sandwiched between the pair of regulating surfaces 7*c* and 7*d*. Therefore, the locking arms 55 and 56 are reliably regulated from moving in the width direction in the locking structure LS, and thus, it is difficult to release the temporarily locked state and the fully locked state even if the female housing 5 and the front holder 7 are moved relative to each other in order to release the temporarily locked state and the fully locked state. As a result, it is possible to further suppress the decrease of the holding force generated by the locking structure LS.

Figure 12:
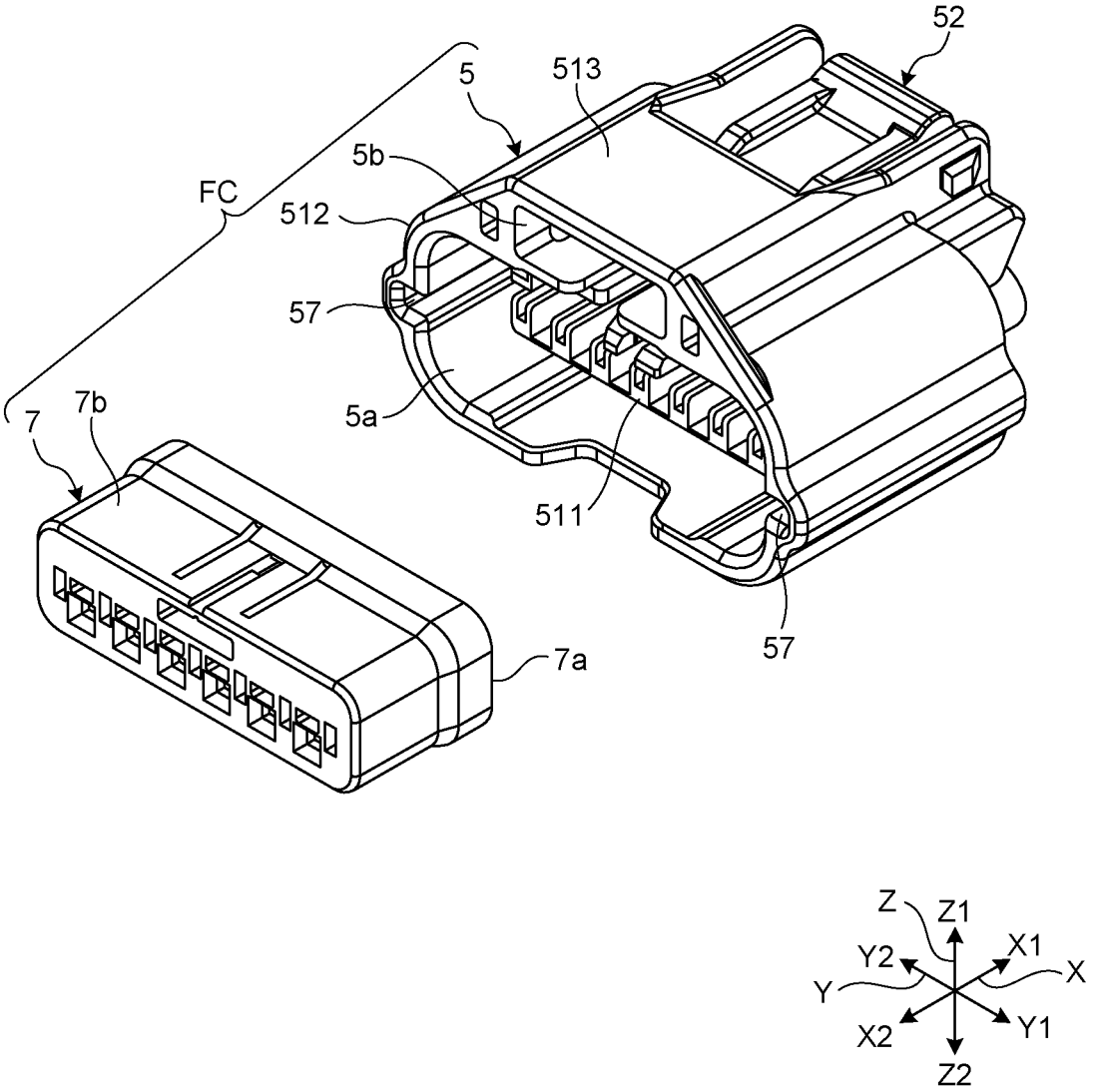
FIG. 12 is an exploded perspective view illustrating a part of a connector (female connector) according to a modified example.
Figure 13:
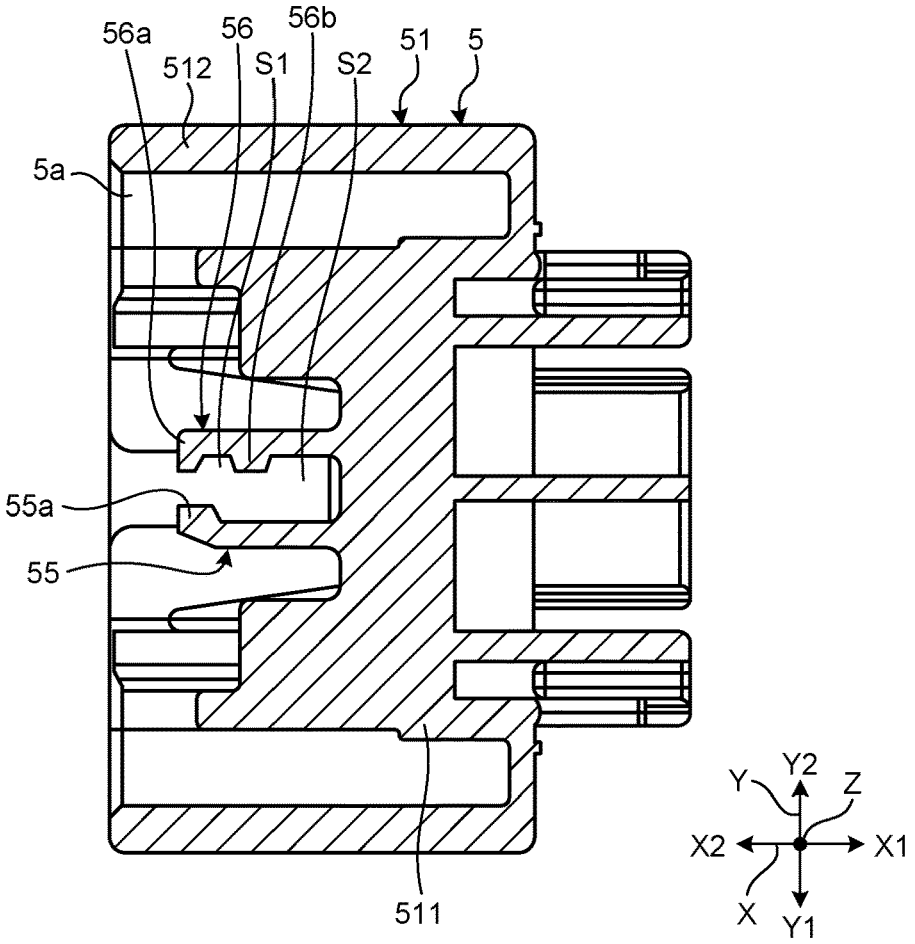
FIG. 13 is a cross-sectional plan view of a female housing according to the modified example.
Figure 14:
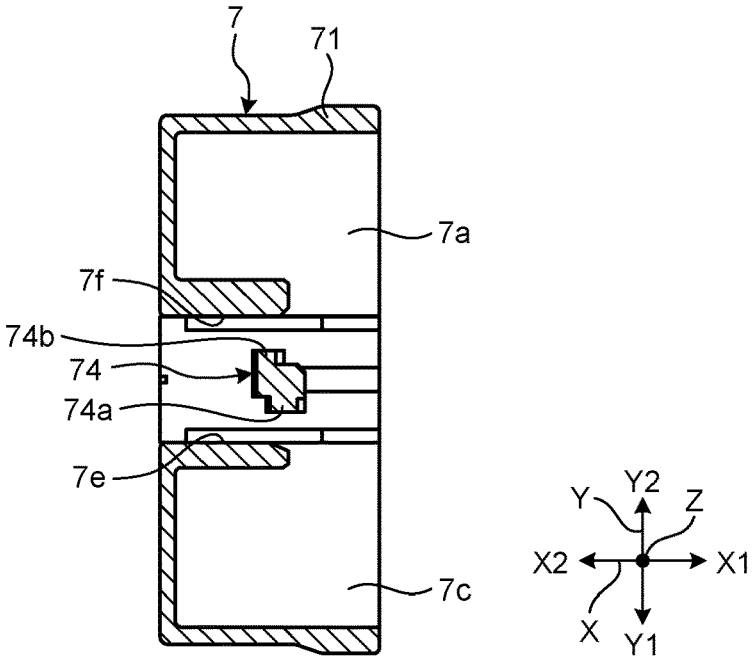
FIG. 14 is a cross-sectional plan view of a front holder according to the modified example.

Incidentally, the locking protrusion 73 is formed on the outer peripheral surface 7*b* of the front holder 7 in the female connector FC according to the above embodiment, but the invention is not limited thereto. FIG. 12 is an exploded perspective view illustrating a part of a connector (female connector) according to a modified example. FIG. 13 is a cross-sectional plan view of a female housing according to the modified example. FIG. 14 is a cross-sectional plan view of a front holder according to the modified example. Here, FIG. 12 is a view not illustrating the female terminal 6, the CPA member 8 and the waterproof packing 9. As illustrated in FIGS. 12 and 13, in the female connector FC according to the modified example, a locking protrusion 74 is formed on an inner peripheral surface constituting the insertion space 7*a* of the body portion 71 of the front holder 7. Incidentally, since the basic configuration and basic operation of the female connector FC according to the modified example are the same as those of the female connector FC according to the embodiment, the same reference numerals will be omitted or simplified.

As illustrated in FIG. 13, the locking arm 55 has only the temporary locking portion 55*a*. The locking arm 56 has the temporary locking portion 56*a* and the full locking portion 56*b*.

As illustrated in FIGS. 12 and 14, the front holder 7 has regulating surfaces 7*e* and 7*f* and the locking protrusion 74 in the insertion space 7*a*. The regulating surfaces 7*e* and 7*f* are provided to be apart from each other to face the locking protrusions 74 in the width direction, and regulate the locking arms 55 and 56, respectively, from moving in the width direction when each of the locking arms 55 and 56 faces the locking protrusions 74 in the width direction. The regulating surfaces 7*e* and 7*f* according to the present embodiment are side surfaces facing each other in the width direction of a pair of protruding portions each of which is formed as a part of the detachment-direction-side end of the body portion 71 protrudes to the insertion direction side in the insertion space 7*a*.

The locking protrusion 74 is formed to protrude in the downward direction in a center portion in the width direction of the surface on an upward direction side of an inner peripheral surface. When viewed from the vertical direction, the locking protrusion 74 is formed to extend in the fitting direction, has both partially protruding ends in the width direction, and is formed with a first locking protruding portion 74*a* corresponding to the locking arm 55 and a second locking protruding portion 74*b* corresponding to the locking arm 56. The locking protrusion 74 is formed in a substantially S shape when viewed from the vertical direction. Incidentally, the temporary locking space S1 in which the locking protrusion 74 is temporarily locked between the temporary locking portions 55*a* and 56*a* and the full locking portion 56*b*, and the full locking space S2 in which the locking protrusion 74 is fully locked between the full locking portion 56*b* and the detachment-direction-side end of the first body portion 511 are formed between the locking arms 55 and 56.

Next, the holding of the front holder 7 with respect to the female housing 5 according to the modified example will be described. When the front holder 7 is arranged to face the first body portion 511 in the fitting direction and the first body portion 511 is inserted into the insertion space 7*a* of the front holder 7 from the detachment-direction-side end as illustrated in FIG. 12, the temporary locking portions 55*a* and 56*a* and the locking protruding portions 74*a* and 74*b* come into contact with each other, the locking arms 55 and 56 are elastically deformed in the upward direction, the temporary locking portions 55*a* and 56*a* override the locking protrusion 74 to be positioned inside the temporary locking space S1, and the front holder 7 is turned into the temporarily locked state with respect to the female housing 5. Next, when the front holder 7 is further inserted, the full locking portion 56*b* and the second locking protruding portion 74*b* come into contact with each other, only the locking arm 56 is elastically deformed in the upward direction, the full locking portion 56*b* overrides the locking protrusion 74 to be positioned inside the full locking space S2, and the front holder 7 is turned into the fully locked state with respect to the female housing 5.

In addition, the two locking portions 55*a* and 55*b*, and the two locking portions 56*a* and 56*b* are formed on each of the pair of locking arms 55 and 56 in the above-described embodiment and modified example, but the invention is not limited thereto, and it suffices if one or more locking portions are formed on one locking arm. For example, the respective temporary locking portions 55*a* and 56*a* may be formed on each of the pair of locking arms 55 and 56 in the locking structure LS so that the temporary locking portions 55*a* and 56*a* function as the full locking portions 55*b* and 56*b*.

In addition, the locking structure LS is constituted by the pair of locking arms 55 and 56, the one locking protrusion 73 or 74 and the pair of regulating surfaces among the regulating surfaces 7*c* to 7*f* in the above-described embodiment and modified example, but the invention is not limited thereto. The locking structure LS may be constituted by one locking arm, one locking protrusion, and one regulating surface.

In addition, the locking arms 55 and 56 are provided on the female housing 5 and the locking protrusion 73 or 74 is provided on the front holder 7 in the above-described embodiment and modified example, but the invention is not limited thereto. In the female connector FC, the locking protrusion 73 or 74 may be provided on the female housing 5 and the locking arms 55 and 56 may be provided on the front holder 7.

In addition, the locking arms 55 and 56 are the deformable members elastically deformed in the vertical direction with respect to the female housing 5 in the above-described embodiment and modified example, but the invention is not limited thereto, and the locking protrusions 73 and 74 may be formed as deformable members elastically deformed in the vertical direction with respect to the front holder 7.

In addition, the first direction is the vertical direction, and the second direction is the width direction in the above-described embodiment and modified example, but the invention is not limited thereto, and it may be configured such that the deformable member is elastically deformed in the width direction with the first direction as the width direction and the second direction as the vertical direction. In this case, since the overriding direction is the width direction, and the direction in which forcible removal is performed is the vertical direction, an arm insertion hole, which extends in the fitting direction and into which the locking arms 55 and 56 are inserted, may be formed in the body portion 71 of the front holder 7. An upper inner peripheral surface and a lower inner peripheral surface constituting the arm insertion hole serve as the regulating surfaces 7*c*, 7*d*, 7*e*, and 7*f*. On the other hand, the locking portions 55*a*, 55*b*, 56*a*, and 56*b* are formed on both inner peripheral surfaces in the width direction constituting the arm insertion hole. That is, by forming a hole shape surrounding the locking arms 55 and 56 in the body portion 71 of the front holder 7, the locking arms 55 and 56 override the locking portions 55*a*, 55*b*, 56*a*, and 56*b* in the width direction, and each elastic deformation of the locking arms 55 and 56 in the vertical direction is formed by the upper inner peripheral surface and the lower inner peripheral surface during the override.

According to the present embodiment, it is possible to suppress the decrease of the holding force generated by the locking structure.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a connector housing that accommodates a terminal to be connected in a fitting direction to a mating terminal accommodated in a mating connector housing;

a front holder into which a part of the connector housing is inserted and that regulates movement of the terminal in a detachment direction of the fitting direction; and a locking structure that locks the front holder with respect to the connector housing, wherein the locking structure includes a locking protrusion provided on one of the connector housing and the front holder and formed to protrude in a first direction orthogonal to the fitting direction, at least one locking arm provided on the other of the connector housing and the front holder and formed to extend in the fitting direction, and at least one regulating surface provided to face the locking protrusion in a second direction orthogonal to the fitting direction and the first direction and regulating movement of the locking arm in the second direction when the locking arm faces the locking protrusion in the second direction, the locking arm is inserted between the locking protrusion and the regulating surface and in which one or more locking portions at least partly overlapping with the locking protrusion are formed when viewed from the fitting direction, one of the locking arm and the locking protrusion is a deformable member that is elastically deformable in the first direction and the second direction with respect to the connector housing or the front holder provided with the one of the locking arm and the locking protrusion, and the deformable member elastically deforms in the first direction when the locking portion and the locking protrusion face each other in the second direction so that the locking portion overrides the locking protrusion.

2. The connector according to claim 1, wherein a pair of the locking arms is provided to be apart from each other in the second direction, the locking protrusion is inserted between the pair of locking arms, and a pair of the regulating surfaces is provided to be apart from each other in the second direction.

3. The connector according to claim 1, wherein the locking protrusion is formed to protrude in the second direction in a recessed portion formed by causing a part of the front holder to be recessed inward, the regulating surface is a side surface forming the recessed portion, and the locking arm is inserted into the recessed portion when being inserted between the locking protrusion and the regulating surface.

4. The connector according to claim 2, wherein the locking protrusion is formed to protrude in the second direction in a recessed portion formed by causing a part of the front holder to be recessed inward, the regulating surface is a side surface forming the recessed portion, and the locking arm is inserted into the recessed portion when being inserted between the locking protrusion and the regulating surface.

* * * * *